United States Patent [19]

Kreitzberg et al.

[11] Patent Number: 4,903,420

[45] Date of Patent: Feb. 27, 1990

[54] MINING TOOTH POINT

[75] Inventors: John S. Kreitzberg; Herbert E. Jones; Terry L. Briscoe, all of Portland, Oreg.

[73] Assignee: Esco Corporation, Portland, Oreg.

[21] Appl. No.: 260,080

[22] Filed: Oct. 20, 1988

[51] Int. Cl.[4] ..... E02F 9/28

[52] U.S. Cl. ..... 37/195; 37/142 A; 299/92; 403/324; 403/379

[58] Field of Search ..... 37/142 A, 142 R, 141 T, 37/141 R, 195; 299/92; 403/324, 379

[56] References Cited

U.S. PATENT DOCUMENTS

| | | | |
|---|---|---|---|
| 2,919,506 | 1/1960 | Larsen | 37/142 A |
| 3,079,710 | 3/1963 | Larsen et al. | 37/142 A |
| 3,126,654 | 3/1964 | Eyolfson et al. | 37/142 A |
| 4,182,058 | 1/1980 | Poncin | 37/142 A |
| 4,231,173 | 11/1980 | Davis | 37/142 R |
| 4,335,532 | 6/1982 | Hahn et al. | 37/142 R |
| 4,414,764 | 11/1983 | Johansson et al. | 37/142 A X |
| 4,455,771 | 6/1984 | Poncin | 37/142 A |
| 4,823,487 | 4/1989 | Robinson | 37/142 A |

OTHER PUBLICATIONS

Esco Catalog 187A "Points and Adapters" effective Jun. 1977.

*Primary Examiner*—Edgar S. Burr
*Assistant Examiner*—Moshe I. Cohen
*Attorney, Agent, or Firm*—Tilton, Fallon, Lungmus & Chestnut

[57] ABSTRACT

A tooth point having key slots top and bottom wherein the rear walls of the slots are outwardly convergent relative to the front walls to permit receipt of a curved locking pin.

1 Claim, 2 Drawing Sheets

MINING TOOTH POINT

BACKGROUND AND SUMMARY OF INVENTION:

This invention relates to a mining tooth point and, more particularly, to a point that is more easily installed on but more difficultly removed from the supporting adapter.

Notwithstanding subsequent tooth developments in the form of co-owned Pat. No. 4,231,173 (the SUPER CONICAL ®) and No. 4,335,532 (the HELILOK ®), the tooth that has remained the standard for mining is the No. 77 CONICAL ®. This tooth is a combination of co-owned Pat. Nos. 2,919,506 and 3,079,710 and employs a pin lock of the type seen in Pat. No. 3,126,654.

The designation 77 relates to the fact that the horizontal dimension of the tooth point socket measures 7.7 inches at the conical axis adjacent the rear of the point. The principal problem with these points is the difficulty of installing the locking pin. The problem is not so severe in some instances with the smaller teeth and the larger teeth employ a spool and wedge.

The point and adapter nose have aligned vertically extending openings into which a "corrugated" pin is installed—to cooperate with a complementary rubber lock or keeper. A frequent experience has been that the strongest man in the shift equipped with a heavy sledge has extreme difficulty in driving the locking pin to final assembly. It should be appreciated that these teeth parts are quite heavy, the point weighing upwards of 100 pounds and the adapter upwards of 400 to 500 pounds. Replacement is often performed under arduous conditions in the field. It also will be appreciated that the points wear rapidly and require replacement. Depending upon the abrasiveness of the material being excavated, a point may last from a matter of hours to a matter of days or weeks. In any event, there is relatively frequent replacement—at least in terms of the adapter life. Normally an adapter will last from about 5 to about 30 replacement points.

The problem of installation has been solved by the instant invention through the use of a pair of novel shaped pin-receiving openings in the point which accommodate the receipt of a complimentarily shaped pin. More particularly, the rear generally vertical walls of the point pin openings have been changed from being co-planar to now being each outwardly convergent with its associated pin opening front wall.

This makes use of a pin with a corresponding inclination making possible (a) more offset between the inner ends of the point opening rear walls and the nose opening rear wall than the offset characteristic of the same tooth according to the prior art having vertical rear walls in the point openings, thereby providing more takeup of the point on the adapter nose; (b) less interference in installation, and (c) increased bearing area between the pin and point opening rear walls.

Pertinent art are Pat. Nos. 4,182,058 and 4,455,771 which show an inclined rear wall in one of the point pin opening but for a different purpose.

Other objects and advantages of the invention will be seen in the details of the ensuing specification.

The invention is described in conjunction with the accompanying drawing, in which.

Figure 1:
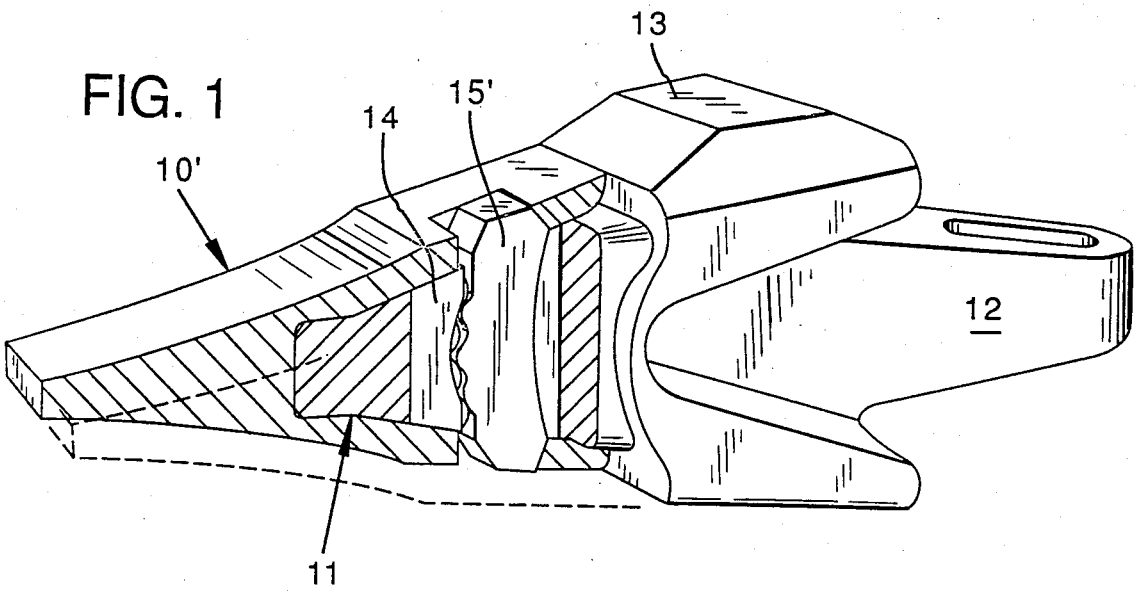
FIG. 1 is a perspective view, partially broken away of a tooth equipped with the inventive point.

DETAILED DESCRIPTION:

In the illustration given and with reference to FIG. 1, the numeral 10' designates generally the inventive point which is seen to be mounted on the nose generally designated 11 of the adapter 12. The adapter 12 is seen to be equipped with a wear cap 13 which is optional. Completing the assembly of the mining tooth are a plug 14 and a pin 15'. The prior art elements lack the prime (').

Prior Art Representation

Figure 2:
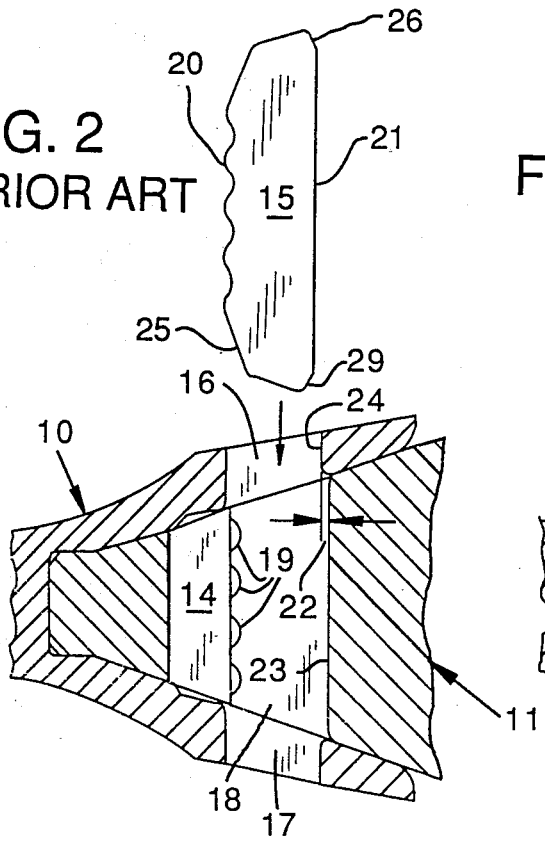
FIG. 2 PRIOR ART
FIG. 2 is an exploded fragmentary side elevational view, partially in section of the prior art 77 tooth.

The interrelationship of the parts of the mining tooth can be readily appreciated from the exploded view seen in FIG. 2. There, again, the point is generally designated by the numeral 10 and is seen to have vertically aligned openings 16 and 17. The nose 11 is seen to have a vertically extending opening 18 which is generally alignable with the openings 16 and 17. The plug or keeper 14 is seen to be equipped with four projections 19 developed by cylindrical inserts in the fashion shown and described in Pat. 3,126,654.

The pin 15 (shown spaced above the point-nose combination) has five projections or "bumps" as at 20 and these are all in a line, i.e., the tips are coplanar. The rear of the pin at 21 is completely flat.

Referring to the lower portion of FIG. 2, there is an offset 22 between the back 23 of the key slot or opening 18 in the nose and the back 24 of the pin opening 16 in the point. This offset allows takeup for the point on the nose as the nose surface wears down. The larger this offset, the more takeup is available for a point-nose assembly.

Referring to the upper part of FIG. 2, there is a large bevel at 26 and 29 at each end of the pin 15 to facilitate installing the pin past the offset 22 in the point-nose assembly.

Figure 3:
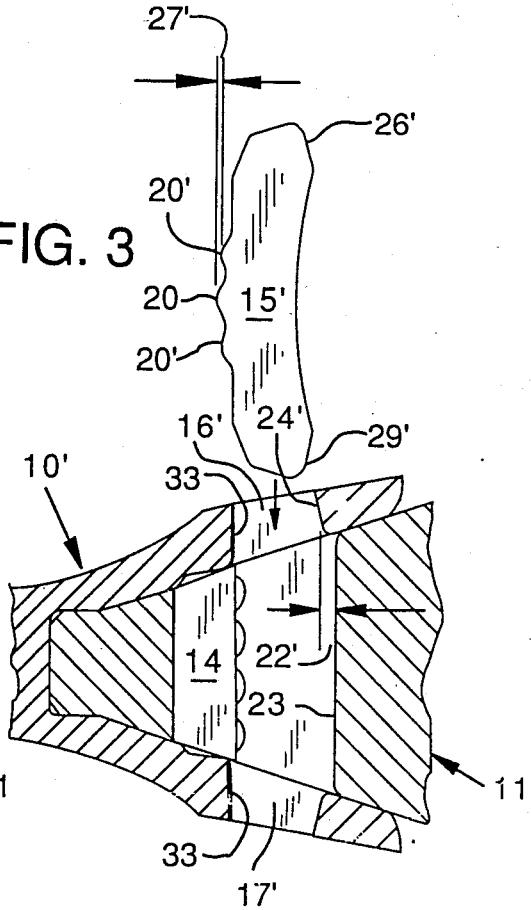
FIG. 3 is a view essentially similar to that of FIG. 2 but featuring the inventive point and complimentarily shaped pin.

Invention According to FIG. 3

In FIG. 3 like numerals are employed for elements identical to those just described in FIG. 2. Where the element is different, a prime (') is added. Thus, the nose is designated by the numeral 11 because it remains unchanged. However, the point is designated generally by the numeral 10' to indicate that there is a change between the two showings. The difference in the points resides in the provision of a forward bevel or inclination 24' on the back edge of each of the pin openings 16' and 17' in the point. This provides a substantially greater amount of offset 22' between the bottom (not the top) of the rear wall 24' of the key slot 16'. This increased amount of offset 22' allows for more takeup of the point on the nose in cooperation with the increased bevel 26' on the back of the pin 15'. This increased bevel can be appreciated by comparing the top portions of FIGS. 2 and 3 and in particular the bevels at 26 in FIG. 2 and 26' in FIG. 3.

Still referring to the upper portion of FIG. 3, there is provided an offset 27' between the center bump 20 and each of the two adjacent bumps 20'. Please note that there are only three bumps on the front of the pin 15' rather than the five that are on the prior art pin 15. Another significant feature of the new pin 15' is that it has the ends of the pin beveled with only a small radius at the very end of the pin rather than the large chamfers that are characteristic of the prior art pin 15.

Figure 4:
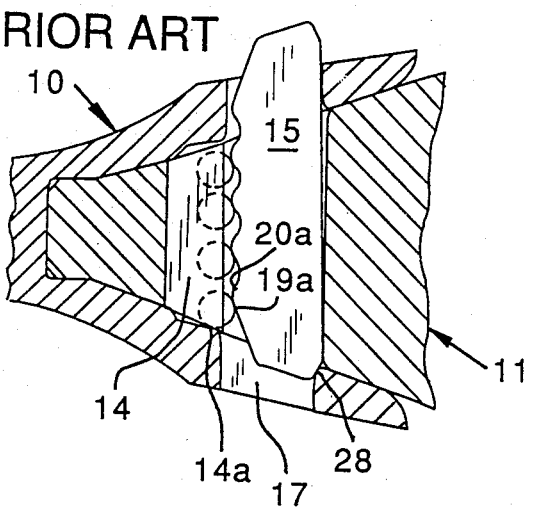
FIG. 4 PRIOR ART
FIG. 4 is another view of the prior art tooth showing the pin partially assembled in the aligned openings in the point and adapter nose.
Figure 5:
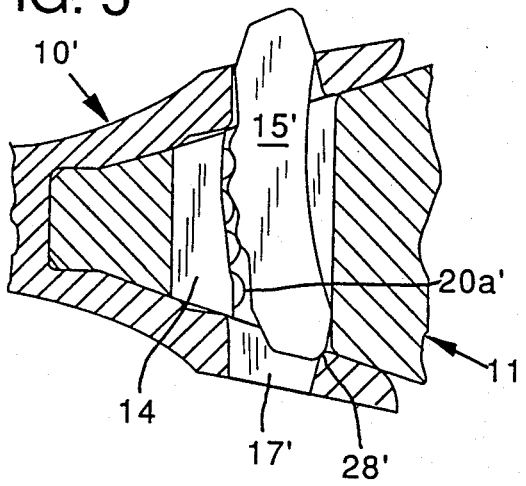
FIG. 5 is a view corresponding to that of FIG. 4 but with the inventive point and pin being illustrated.

FIGS. 4 and 5

These two views show the pin partially installed within the pin openings of the assembled point-nose combination. In both cases, the pins are driven in from the top. It is to be noted that at the location 28 at the bottom of the assembly, the offset between the pin opening or key slot in the nose and the key slot in the point is causing difficulty for the pin to slide by this location. That is the reason for the large bevel or radius at the extreme lower end of the back of the pin as at 29—see the upper portion of FIG. 2. Also, it will be appreciated that at the same time the pin 15 hits the obstacle at the location 28 during assembly, the first bump on the front of the pin as at 20*a* in FIG. 4 also contacts the last steel cylinder 19*a* in the rubber lock 14. As the pin 15 goes past the point 28 (or the offset between the point and nose), it is forced forward and down on the cylindrical insert 19*a*. This makes it extremely difficult to drive the pin into this assembly because the last steel cylinder is driven against the inside surface of the point at the location 14*a*. It has been experienced that on difficult assemblies that after the installation of the pin, one can remove the pin and find this cylinder broken and the rubber lock destroyed.

FIG. 5 shows the pin 15' driven into a new point and nose assembly. This is at the same stage of installation as that shown in FIG. 4. It is to be noted that in FIG. 5 there is no significant interference at the point 28'. This is the contact area at the bottom of the inside of the point at assembly because of the fact that a large bevel is provided at the back of the pin as at 26' and 29'. It is also to be noted that instead of trying to compress the last cylinder in the lock 14 at the same time the pin 15' is trying to jump past the area 28', there is a clearance instead between the pin 15' and the bottom cylinder 20*a*'.

Figure 6:
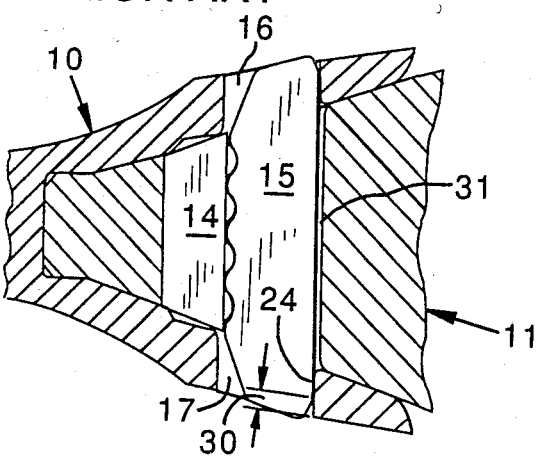
FIG. 6 PRIOR ART
FIG. 6 is again a fragmentary, side elevational view partially in section of a pin adapter nose and point in assembled condition as would be characteristic of the prior art.
Figure 7:
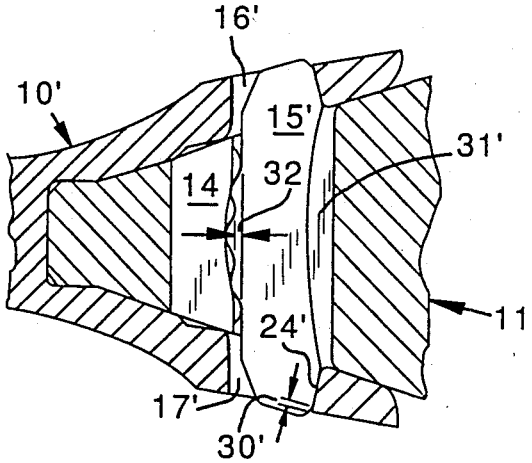
FIG. 7 is a view of the inventive construction corresponding to the showing in FIG. 6.

Complete Installation—FIGS. 6 and 7

FIG. 6 shows a fully engaged pin in the assembly of point 10 and nose 11. It is to be noted that there is a dimension 30 at the bottom showing the effect of the large bevel on the back of the pin 15 has with respect to the surface contact between the pin 15 and the rear wall 24 of the key slot 17. It also will be appreciated that there is a very slight amount of take up or clearance between the back of the nose slot and the back of the pin as at 31.

On the other hand, FIG. 7 shows a fully installed pin with the new point 10', a standard nose 11 and a standard plug or lock 14. It is important to note the difference between the compression on the rubber lock 14 at the center thereof as shown by the dimension 32. This increased compression holds the point 10' tighter on the nose 11 and increases the stability of the entire system. Also, please note the amount of clearance between the back of the pin and the back of the key slot in the nose as at 31'. This increased clearance allows for more takeup which is provided by the increased compression on the rubber lock.

Another significant thing about this system is that there is virtually 100% contact between the back of the pin 15' and the mating surface of the point. The slight departure from this is designated by the numeral 30' applied to the dimension at the lower right hand portion of FIG. 7.

Increased stability is afforded because for the pin 15' to move out of the FIG. 7 position, it now has to climb up out of a valley formed by the two interfaces between the bevels on the back edge of the point pin openings. It is also cradled in a curved portion of the lock which surrounds the three bumps at the front of the pin.

The particularly advantageous features of the invention are:

1. Much easier installation of the pin into the assembly because of the bevels at the back end of the pin providing ramp surfaces of the order of about 15° and eliminating the interference present on the prior art system;
2. Elimination of the bottom outside bumps on the pin, eliminating the interference between that bump and the bottom cylinder at installation;
3. Increased allowable offset between the back of the pin opening in the nose and the back of the pin openings in the point allowing for more takeup of the point on the nose; and
4. Curvature on the front of the pin 15' formed by the bumps not being in a straight line and therefore forcing the rubber lock to wrap around this pin when it is fully installed.

It has been noted that the inventive system is easier to install, even in very cold weather, does not damage the rubber lock at installation (as did the previous system) and is more stable after installation. The inventive system also requires more energy to disassemble because of the ramps on the two surfaces and the curvature at the front of the pin which is beneficial to pin retention during operation.

While in the foregoing specification a detailed description of an embodiment of the invention has been set down for the purpose of explanation, many variations in the details herein given may be made by those skilled in the art without departing from the spirit and scope of the invention.

I claim:

1. A method of installing a new tooth point on a used adapter, said adapter being a relatively elongated unitary metal body having a forwardly projecting nose at one end, said nose being defined by upper and lower walls flanked by slightly forward convergent side walls, said upper and lower walls adjacent the nose rear being partial surfaces of revolution generated about a vertical generatrix located adjacent the nose rear, said upper and lower nose walls being generally horizontal adjacent the nose forward end to provide stabilizing surfaces against the negative thrust components of a beam loading, said upper and lower walls adjacent to but spaced from said nose rear being equipped with a vertically-extending cored opening for the receipt of a locking pin, said pin opening having a generally vertical rear wall and being forwardly enlarged to receive a resilient lock, said lock having four vertically spaced, rearwardly projecting cylindrical inserts adapted to confront said locking pin, comprising:

providing a new tooth point which includes a generally wedge-shaped, relatively elongated unitary metal body having a digging edge at its forward end and a socket extending forwardly from its rear end, said socket having interior walls conforming to said side, upper and lower walls of said nose, the upper and lower interior walls of said socket adjacent to but spaced from said point rear end being equipped with aligned upper and lower openings for the receipt of said locking pin for securing said point to said adapter by extending through said cored opening in said nose, said point openings being generally rectangular in cross section and extending from said socket walls to the exterior of said point, each opening being defined by front and rear walls flanked by generally parallel sidewalls, the front walls of said upper and lower openings being co-planar while each of side rear walls are inclined at about 15° so as to be outwardly convergent with its associated front wall, mounting said tooth point on said adapter nose with the pin openings of said point being generally aligned with the pin opening of said nose, inserting a locking pin into the upper pin opening of said point and partway into the pin opening of said nose, said locking pin being a vertically elongated, unitary metal body having front and rear walls, said rear wall having bevels of about 15° adjacent the pin ends, said front wall being equipped with three integral vertically spaced, horizontally extending projections spaced from the pin ends, the forward portions of said three projections being not co-planar with the middle projection extending more forwardly than the uppermost and lowermost projections, said pin rear wall confronting the rear wall of said nose opening and being forwardly concave between said end bevels, and while exerting a downward force on the upper end of said pin simultaneously sliding the upper end of the pin lower bevel against the rear wall of said nose opening and engaging the middle projection of said pin with an intermediate one of said four inserts to avoid the lowermost projection forcing the lowermost insert against the socket lower interior wall whereby less interference is encountered in installation while, at the same time the combination of the pin rear wall bevels and the forward concavity provide (a) more offset between the inner ends of said point opening rear walls and said nose opening rear wall than the offset characteristic of the same tooth having vertical rear walls in the point openings and using a pin without such concavity, (b) less interference in operation, and (c) increased compression of the center of said lock by the middle of the three projections of said pin to hold the point tighter on the nose.

* * * * *